United States Patent [19]

Kitao et al.

[11] Patent Number: 4,495,391

[45] Date of Patent: Jan. 22, 1985

[54] ALTERNATE ON-OFF SWITCH MECHANISM

[75] Inventors: Zenichi Kitao, Nagaokakyo; Haruyuki Koizumi, Kyoto, both of Japan

[73] Assignee: Omron Tateisi Electronics Co., Kyoto, Japan

[21] Appl. No.: 454,270

[22] Filed: Dec. 29, 1982

[30] Foreign Application Priority Data

Dec. 29, 1981 [JP] Japan ..... 56/196815[U]
Jan. 13, 1982 [JP] Japan ..... 57/4382

[51] Int. Cl.[3] ..... H01H 3/12; H01H 13/56

[52] U.S. Cl. ..... 200/153 J; 200/153 LA; 200/284

[58] Field of Search ..... 200/153 J, 284, 153 LA, 200/153 M, 340

[56] References Cited

U.S. PATENT DOCUMENTS 1,352,889 9/1920 Gallo et al. ..... 200/153 J
2,749,415 6/1956 Davis ..... 200/153 J
2,890,387 6/1959 Wiley et al. ..... 200/153 J
3,619,532 11/1971 Lyvang ..... 200/292
4,129,764 12/1978 Ohkita et al. ..... 200/153 J X

*Primary Examiner*—John W. Shepperd
*Assistant Examiner*—Renee S. Kidorf
*Attorney, Agent, or Firm*—Wegner & Bretschneider

[57] ABSTRACT

An alternate mechanism comprising a plunger (4) supported for a linear movement, a rotary cam (71) rotatably supported by the plunger, a spring (43) for biasing the plunger toward an original position ($P_1$) of the plunger, a first stationary cam (76) which as the plunger is pushed to a first position ($P_2$, $P_3$) against the spring, is adapted to be engaged with the rotary cam so as to rotate the rotary cam by a predetermined angle, and a second stationary cam (32) which as the plunger supporting the rotary cam at the predetermined angle returns from the first position, is engaged with the rotary cam so as to lock the plunger in a second position ($P_4$), and as the plunger locked in the second position is pushed again, the rotary cam is further rotated by the first stationary cam so as to be disengaged from the second stationary cam when the plunger returns to the second position.

1 Claim, 7 Drawing Figures

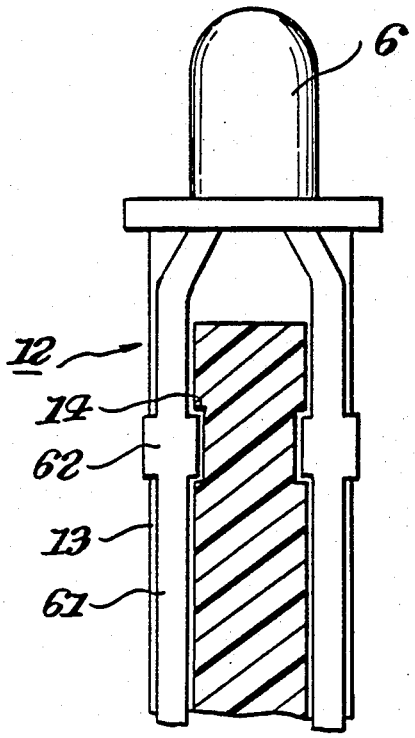
FIG. 3
FIG. 4
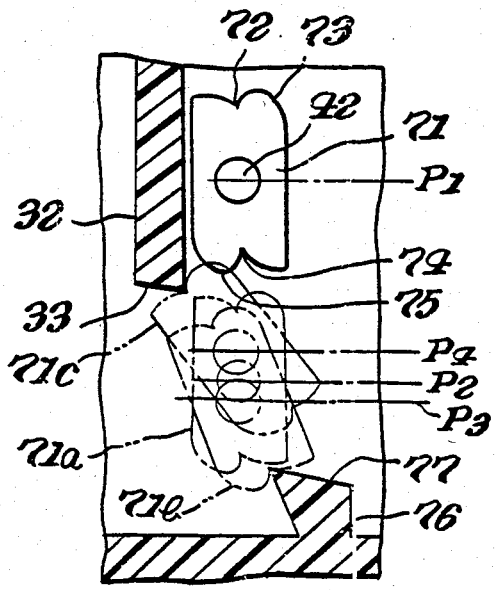

ALTERNATE ON-OFF SWITCH MECHANISM

BRIEF SUMMARY OF THE INVENTION

This invention relates to an alternate on-off switch mechanism, and more particularly, to an improved mechanism which may be employed in a push-on-and-push-off switch.

There is well known an alternate on-off switch mechanism which includes a heart-shaped groove formed on a plunger and a swingable lever associated with a spring wire having a fixed base end so that a free end of the swingable lever swings along the heart-shaped groove. Such a conventional switch mechanism, however, has the disadvantage that the mechanical life of the mechanism is not satisfactory due to a severe dimensional accuracy of the swingable lever, an abrasion of plastics by sliding metal or the like. Moreover, each detailed dimension of the swingable lever must be precisely adjusted with the heart-shaped groove on assembling so as to avoid any misoperation of the mechanism, so that its assembling work is complicated and the reduction of cost of the assembled mechanism is not easy.

It is, therefore, a primary object of this invention to provide an alternate on-off switch mechanism which has a long mechanical life, performs a secured operation, and is easy to assemble.

It is a further object of this invention to provide an alternate on-off switch mechanism which is protected against entry of any foreign matter into the mechanism so as to ensure a smooth, efficient mechanical operation.

It is a still further object of this invention to provide an alternate on-off switch mechanism including a rotary cam and a stationary cam which are made of molded plastics.

Other objects as well as the numerous advantages of the alternate mechanism according to this invention will become apparent from the following detailed description and the accompanying drawings, in which:

BRIEF DESCRIPTION OF DRAWINGS

FIG. 3 is an elevation view of a light emitting diode employed in the switch of FIG. 2;

FIG. 4 is the alternate on-off switch mechanism employed in the switch of FIG. 1.

DETAILED DESCRIPTION

Figure 1:
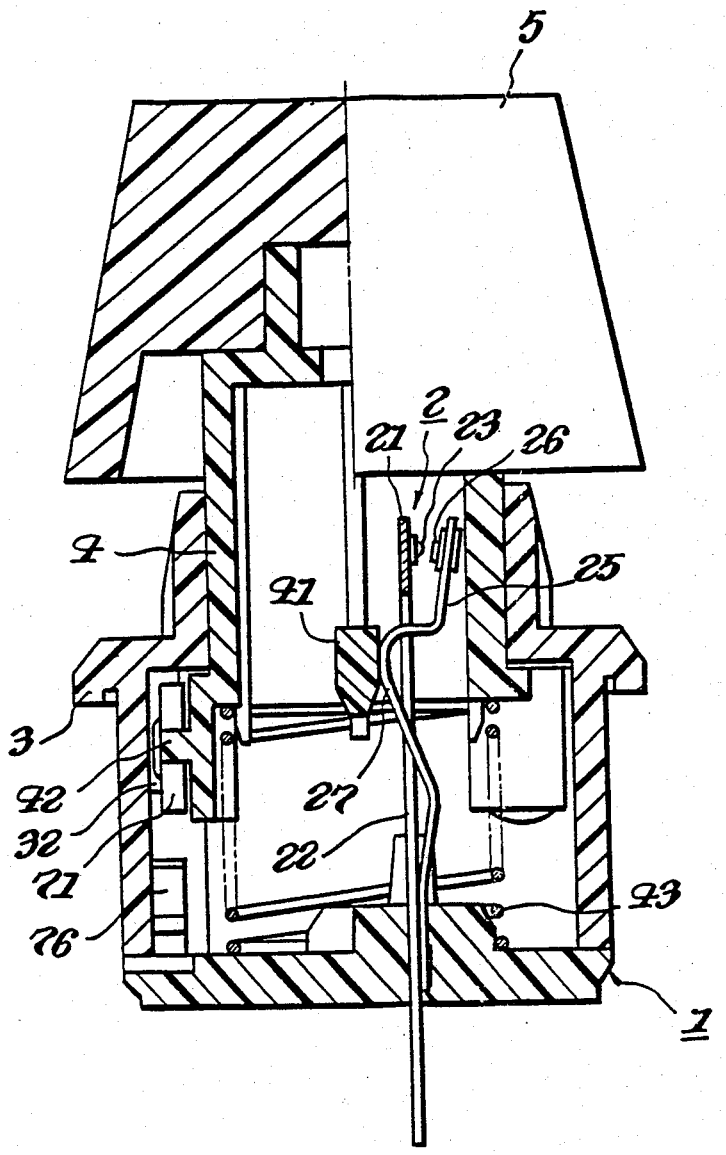
FIG. 1 is a partially sectional elevation view of a keyboard switch employing an alternate on-off switch mechanism as a preferred embodiment of this invention.
Figure 2:
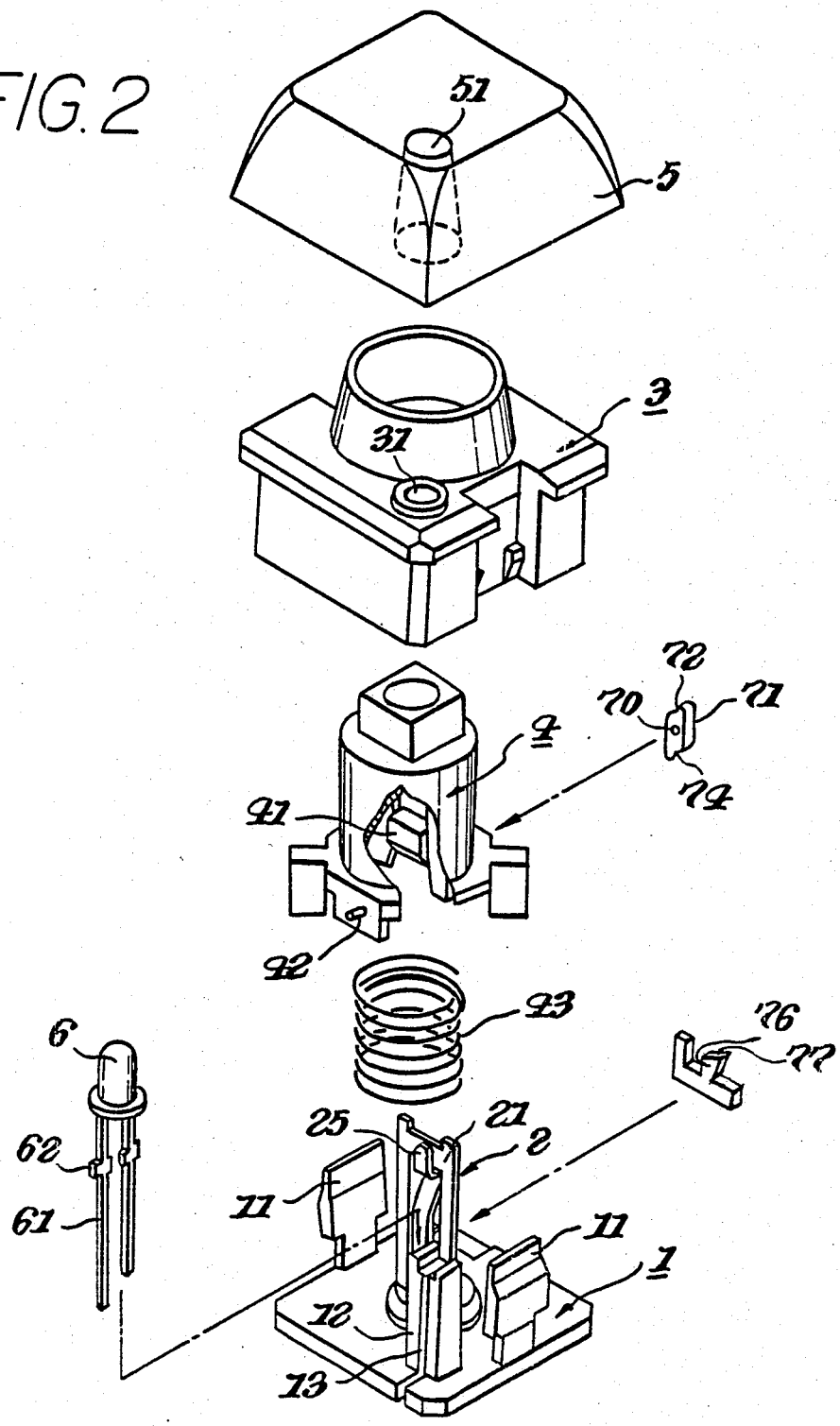
FIG. 2 is a perspective disassembled view of the keyboard switch of FIG. 1.

Referring, now, to FIGS. 1 and 2, there is shown an alternate on-off switch mechanism or push-on-and-push-off mechanism which is employed in a keyboard switch as a preferred embodiment of this invention. A base member 1 is an insert-molded plastic member carrying a contact member 2, and includes springy clips 11 and a light emitting diode (hereinafter, abbreviated as LED) supporter 12 as a single molded unit. A cover 3 is mounted on the base member 1 by engagement with the clips 11 so as to support a plunger member 4 for a vertical sliding movement within the cover 3. The plunger member 4 is upwardly biased by a reset coil spring 43 within the cover 3. The case 3 consists of a lower portion of a square shape, and an upper portion of a cylindrical shape through which a head portion of the plunger member 4 projects so as to be mounted by a key button 5. As illustrated in FIG. 2, there is disposed a window portion 31 on an upper wall of the square portion of the cover 3. The window portion 31 is normally closed by a thin plate which is molded together with the cover 3 as a single unit and easy to be broken to form a hole extending through the window portion 31 if desired.

As illustrated in FIG. 3, the LED supporter 12 is disposed to support a LED 6 on a head portion of the supporter 12. Though other reference numerals in FIG. 3 are made in reference to components in the left-hand of the drawing it should be understood that the same reference numerals 14, 62, 13 and 61 apply to corresponding components depicted in the right-hand of the drawing. A pair of terminals 61 of the LED 6 are so guided by grooves 13 that projecting portions 62 of the terminals 61 are engaged with recesses 14 formed in the grooves 13 for temporarily fixing the LED in a position. As the cover 3 is mounted on the base 1, the temporarily fixed LED 6 is sandwiched between the supporter 12 and an inner wall surface of the cover so as to fix the LED in its position. Then, the lead terminals 61 are guided by the grooves 13 so as to extend below the base member 1, so that any additional connection terminals for the LED are not needed to be disposed on the base member 1. The lights emitted from the LED 6 through the window 31 are guided by a transparent member 51 buried in the key button 5 to be outwardly radiated therefrom. Since the window portion 31 is closed by the thin plate on molding, it must be broken in advance so as to receive the LED 6.

If the keyboard switch of FIG. 2 is designed for a non-illuminated switch, it has only to be modified in such a manner that the LED 6 is not employed, the key button 5 does not have the transparent member 51 and the thin plate in the window portion 31 is not broken. Thus, by employing such common components, this keyboard switch is convertible with ease between illuminated and non-illuminated switches. Since the window portion 31 in such a non-illuminated switch is closed, any foreign matter, such as external dust or the like, is prevented from entering within the cover 3. Alternatively, if the keyboard switch is desired to be soly designed for this illuminated LED switch, the window portion 31 may be molded to include a hole extending therethrough.

The plunger member 4 on its lower opposite side walls includes a pair of stub shafts 42 to be rotatably mounted by a rotary cam 71. As illustrated in more detail in FIG. 4, the rotary cam 71 has a symmetrical configuration with respect to a center hole 70 pierced by the shaft 42. The rotary cam 71 at its periphery is provided with a symmetrical pair of grooves 72 and 74 and a symmetrical pair of sloping surfaces 73 and 75. A first stationary cam 76 having a projection 77 is mounted on a recessed step formed on the base member 1 so as to be fixed by a projection (not shown) formed on an inner wall of the cover 3 as mounted. A second stationary cam 32 is formed on an inner side wall surface of the cover 3 as a single molding.

The operations of the alternate on-off switch mechanism according to this embodiment will be described hereinafter with reference to FIG. 4.

Where the plunger member 4 is in a normal position, viz., in the highest position, the shaft 42 is in the position $P_1$. As the plunger member 4 is downwardly depressed in accordance with the external depression applied to the key button 5 and the shaft 42 comes into the position $P_2$, the cam 71 takes the position shown in two dotted lines 71*a* where a lower surface of the cam 71 comes in contact with an upper surface of the projection 77 of the stationary cam 76. As the plunger member 4 is further depressed, the top end of the projection 77 comes in contact with the groove 74 of the rotary cam 71 and the shaft 42 comes into the position $P_3$ where the rotary cam 71 takes the angular position rotated by about 10 degrees as shown in the two-dotted lines 71*b*. If the key button 5 is released, the rotary cam 71 upwardly moves at the same angular position of about 10 degrees but is stopped by the bottom end 33 of the stationary cam 32 engaged with the upper groove 72 of the cam 71. Then, the shaft 42 is locked in the position $P_4$, and the cam 71 takes the position shown in the two-dotted lines 71*c*. If the key button 5 is depressed again, the plunger member 4 is depressed downwardly and the lower sloping surface 75 comes in contact with the upper surface 77 of the stationary cam 76 because as the upper gloove 72 was engaged with the bottom end 33 in the former operation, the cam 71 has been further rotated in a counterclockwise direction to a certain extent and retains the same angular position. Upon further depression applied to the button 5, the rotary cam 71 further rotates counterclockwise because of the slope 75 engaged with the slope 77. Upon releasing the depression to the button 5, the plunger member 4 moves upwardly and the rotary cam 71 further rotates counterclockwise because the upper sloping surface 73 and a side wall of the cam 71 are pushed by the bottom end 33 of the second stationary cam 32, so that the rotary cam 71 returns to its original position where the shaft 42 is in the position $P_1$.

Thus, the rotary cam 71 is gradually rotated by the stationary cams 76 and 32, so that there is provided an alternate mechanism or a push-on-and-push-off mechanism such that it is locked upon a first depression applied to the key button 5 and is unlocked upon a second depression after releasing of the first depression. It should be understood that the rotary cam 71 is tightly supported by the shaft 42 to such an extent that the cam 71 can be rotated only by the cams 76 and 32 and is hard to be rotated by any external mechanical shock to the cam 71.

If the keyboard switch is desired to be of a non-alternate on-off switch mechanism type or a momentary type having no locking function, the rotary cam 71 and/or the stationary cam 76 have only to be omitted. Thus, by adding such a reduced number of components, the keyboard switch according to this embodiment can be modified from the momentary type to the alternate type. Alternatively, the first cam 76 may be molded to further include the second cam 32 so as to be mounted on the base member 1 as a single component. Or, the first and second cams 76 and 32 may be modified to be formed on an inner wall surface of the plunger member 4. Further alternatively, the first and the second cam 76 and 32 may be formed on an inner wall surface of the plunger member 4 and the base member 1, respectively.

Referring to FIGS. 1 and 2, the contact member 2 consists of an arch-shaped stationary blade 21 having a pair of legs 22 and a springy movable blade 25. The respective blades 21 and 25 carry respective contacts 23 and 26.

Figure 5:
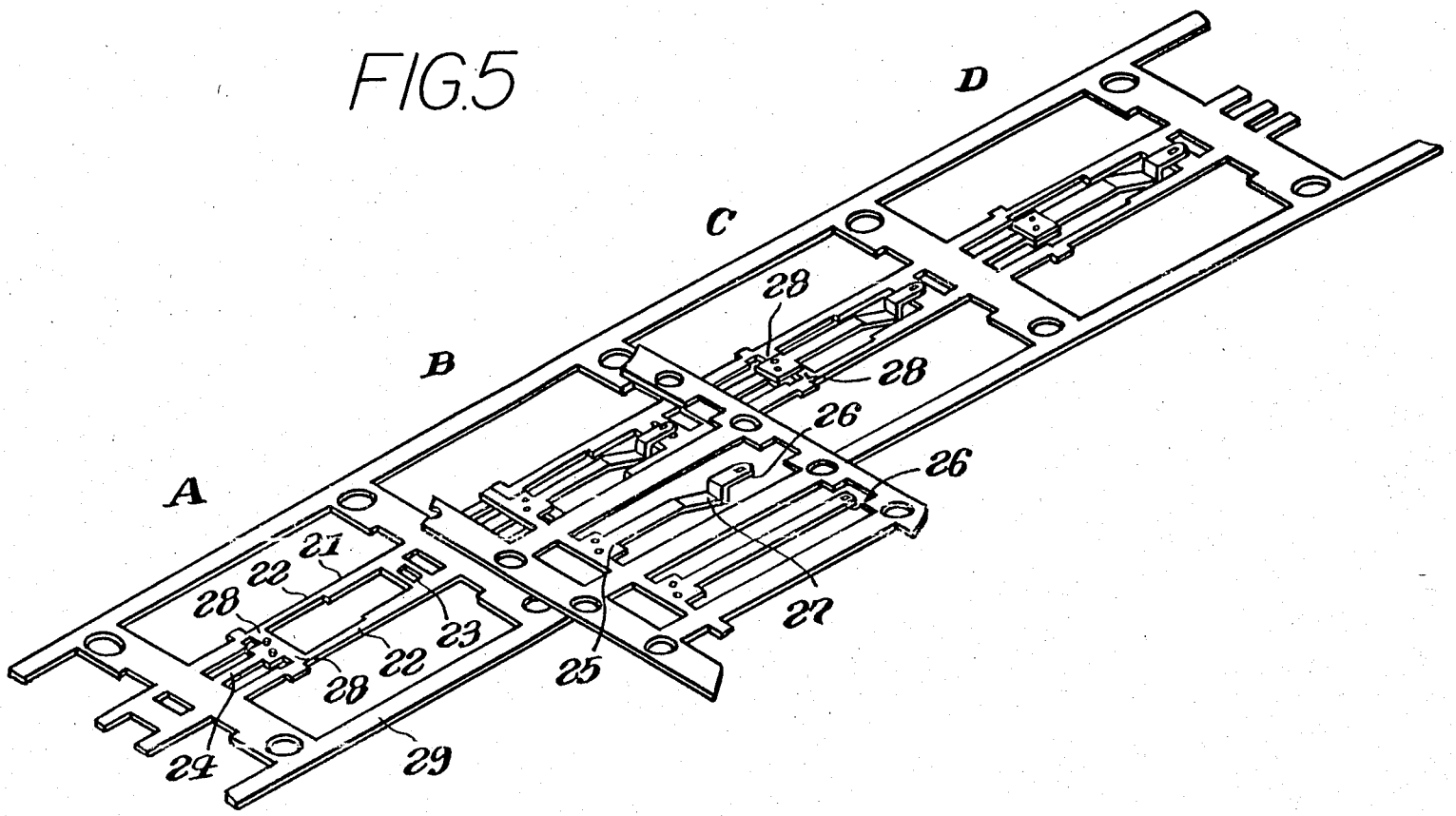
FIG. 5, is perspective view illustrating a first step of a process to make a base member employed in the device of FIG. 2.
Figure 6:
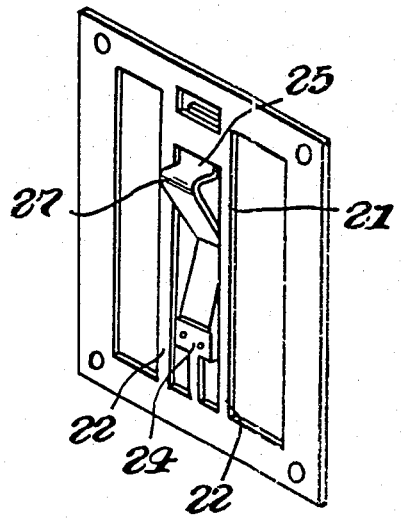
FIG. 6 is a perspective view illustrating the second step of the process.
Figure 7:
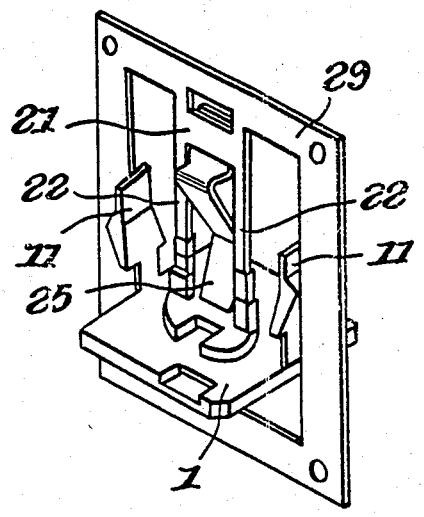
FIG. 7 is a perspective view illustrating the third step of the process.

The contact member 2 may be assembled by the following automated producing processes: In the first step, as illustrated in a section A of FIG. 5, a single metal plate 29 is stamped out to form a hoop-shaped member including the stationary blade 21 having a pair of legs 22 and a terminal 24, and the contact 23 is disposed. In the subsequent step, as illustrated in a section B of FIG. 5, a hoop-shaped member having the movable blade 25 is driven to a predetermined position above the hoop-shaped plate 29 from a side direction. In advance, the movable blade 25 is formed by stamping out a metal plate, the contact 26 is disposed on the blade 25 at its free end, and a bent portion 27 is formed. As the movable blade 25 reaches the above-mentioned predetermined position, it is put upon the plate 29 so as to fixedly mount a base end of the blade 25 on the terminal blade 24. Then, a connecting portion of the movable blade 25 is cut off so as to form a component as illustrated in a section C of FIG. 5. Further, a connecting portion 28 of the terminal blade 24 is cut off to form a component as illustrated in a section D of FIG. 5. Then, such a component is separated one by one so as to form an isolated component shown in FIG. 6. Further, the metal plate of FIG. 6 is inserted in a molded plastic member by an insert-molding process so as to form base member 1 as illustrated in FIG. 7. Finally, a peripheral frame portion of the component of FIG. 7 is cut off so as to constitute the base member 2 shown in FIG. 2.

According to this assembled contact component 2, the legs 22 of the stationary blade 21 downwardly extend through the base member 1 to form connection terminals, and the terminal blade 24 and the blade 21 are made of a single plate so that they can be thick and solid. Therefore, the keyboard switch is easy to be mounted on a printed circuit board without deforming their connecting terminals viz. bottom ends of the blades 24 and 21. Moreover, since the switching terminal 24 is positioned between a pair of interconnected terminals 22, the keyboard switch is available for a simplified connection pattern on a printed circuit board. That is, according to an associated circuit pattern on the board, either of terminals 22 can be connected to other component on the board.

Where the plunger member 4 is in the highest position, the bent portion 27 of the movable blade 25 is pushed by a card 41 formed within the plunger member 4 so that the contacts 23 and 26 are parted each other as illustrated in FIG. 1. As the card 41 moves downwardly upon depressing the key button 5, the card 41 slides on a surface of the portion 27 downwardly so that the springy blade 25 returns toward a left-hand direction of FIG. 1 to close the contacts 23 and 26. Thus, as the button 5 is depressed or locked in a depressed position, the terminals 22 and 24 make a closed circuit. On the contrary, as such depression or lock is released, the terminal 21 and 24 provides an opened circuit.

According to this embodiment, the cover 3 is a molded plastic member having no opening as assembled, so that the assembled keyboard switch is protected from any external foreign matter. Further, according to this invention, there is provided an alternate on-off switch mechanism which can have a long mechanical life and provide a high electrical insulation therein because a rotary cam and of stationary cams are plastic mold members with accurate dimension and can be engaged with one another without abrasion. Moreover, since the respective components constituting the alternate mechanism are molded in highly accurate dimensions, any misoperation, such as inoperative lock and so forth, is prevented from occurring, and any adjustment on assembling is not necessary. By such a simplified assembling work, the alternate on-off switch mechanism can be produced at a reduced cost. If desired, of course, some components of the alternate on-off switch mechanism may be of metal.

It should be understood that the above description is merely illustrative of this invention and that many changes and modifications may be made by those skilled in the art without departing from the scope of the appended claims.

What is claimed is:

1. An alternate on-off switch mechanism comprising a plunger member supported for linear movement, a rotary cam rotatably supported by the plunger member, a spring member for biasing said plunger member toward an original position of the plunger member, a first stationary cam which is adapted to be engaged with said rotary cam so as to rotate said rotary cam by a predetermined angle, as said plunger member is pushed to a first position against the spring member, a second stationary cam which is engaged with said rotary cam so as to lock the plunger member in a second position as the plunger member supporting said rotary cam at said predetermined angle returns from said first position wherein said plunger member when locked in the second position is pushed again, said rotary cam is further rotated by said first stationary cam so as to be disengaged from said second stationary cam when said plunger member returns to said second position, a base member and a cover mounted on the base member so as to enclose said plunger member, said rotary cam, said first and second stationary cams, and said spring member, so that said switch mechanism is protected against entry of foreign matter, and wherein said first stationary member is mounted on said base member and said second stationary cam is formed on an inner wall surface of said cover.

* * * * *